United States Patent [19]

Wiebe

[11] Patent Number: 4,986,192

[45] Date of Patent: Jan. 22, 1991

[54] RAILWAY TRUCK BOLSTER FRICTION ASSEMBLY

[75] Inventor: Donald Wiebe, Sewickley, Pa.

[73] Assignee: A. Stucki Company Division of Hansen Inc., Pittsburgh, Pa.

[21] Appl. No.: 336,344

[22] Filed: Apr. 11, 1989

[51] Int. Cl.[5] ..... B61F 5/12

[52] U.S. Cl. ..... 105/198.4

[58] Field of Search ..... 105/197.05, 198.2, 198.4, 105/198.5, 197.1, 193, 198

[56] References Cited

U.S. PATENT DOCUMENTS

| | | | |
|---|---|---|---|
| 2,456,635 | 12/1948 | Heater | 105/197 |
| 2,465,763 | 3/1949 | Taylor | 105/197 |
| 2,512,829 | 6/1950 | Cottrell | 105/197 |
| 2,548,223 | 4/1951 | Lehrman | 105/197 |
| 2,574,348 | 11/1951 | Orr et al. | 105/197 |
| 2,603,166 | 7/1952 | Clasen | 105/198.2 |
| 3,072,076 | 1/1963 | Warnock | 105/197 |
| 3,109,387 | 11/1963 | Tack | 105/198.5 |
| 3,194,181 | 7/1965 | Tack et al. | 105/198.2 |
| 3,461,815 | 8/1969 | Gedris et al. | 105/198.4 |
| 3,712,247 | 1/1973 | Young | 105/198.5 |
| 3,802,353 | 4/1974 | Korpics | 105/197 DB |
| 3,977,332 | 9/1976 | Bullock | 105/197 D |
| 4,109,585 | 8/1978 | Brose | 105/197 DB |
| 4,254,713 | 3/1981 | Clafford | 105/197 DB |
| 4,256,041 | 3/1981 | Kemper et al. | 105/197 DB |
| 4,274,340 | 6/1981 | Neumann et al. | 105/197 DB |
| 4,570,544 | 2/1986 | Smith | 105/165 |

*Primary Examiner*—Robert P. Olszewski
*Assistant Examiner*—Mark T. Le
*Attorney, Agent, or Firm*—Carothers & Carothers

[57] ABSTRACT

A railway truck and more particularly a truck including a variable bias bolster friction assembly having an elongated retention spring which extends preferably between a side frame spring seat and an inner end portion of a downwardly opening spring pocket formed in a rigid friction shoe, the spring pocket extending upwardly therein to provide space for a maximum length retention spring in a variable bias friction assembly.

10 Claims, 2 Drawing Sheets

RAILWAY TRUCK BOLSTER FRICTION ASSEMBLY

BACKGROUND OF THE INVENTION

In the railway rolling stock art, it has been common practice to support the opposed ends of a freight car body on spaced-apart wheeled truck assemblies for travel along a railway track. The standard truck assembly is commonly referred to as a three-piece truck because its priciple structural members are a pair of laterally spaced side frames which extend longitudinally of the freight car body, and an elongated bolster which extends transversely of the freight car body. The side frames of such a truck typically are supported by a pair of wheel and axle sets which are spaced apart along the track. The longitudinal ends of the bolster are received in openings or windows in the opposed side frames, respectively, and are supported therein by respective spring sets to permit movement of the bolster relative to the side frames. Each spring set typically includes plural elongated coil springs which extend between a spring seat portion the side frame window and a respective undersurface of the bolster end spaced above the side frame spring seat. The freight car body is supported adjacent its longitudinal ends on respective centerplate portions of the truck bolsters.

Normal railway track conditions frequently includes rail running surface variations resulting from such causes as differential track settling due to non-uniform ballast or foundation under the railway ties, excessive rail wear and/or rail misalignment, and rail joints. Under normal operating conditions, these and other non-uniformities can result in truck wheel movements which impart sufficient energy to the truck suspension system to cause the car body to rock, bounce, or sway. If track variations encountered in operation are such that the truck wheel movements become coupled, through the truck spring suspension, to the car body motion, the dynamic response of the system can be reinforced and amplified and the truck wheels can become unloaded. More specifically, car body rocking motion of sufficient magnitude will compress the load springs alternately at the opposed ends of the bolster to a solid or near solid condition. The response of the load springs as they alternately compress and extend can reinforce and amplify the car body rocking motion. As a result, the forces between the wheels and the rail can be significantly reduced alternately on the laterally opposed sides of the truck. In the extreme the wheels will lift from the rail. Any such wheel unloading substantially increases the risk of a derailment.

The most common expedient presently employed to control rocking and other dynamic responses of railway car bodies and trucks is the friction assemblies which provide bolster-to-side frame damping and fit up. Such friction assemblies commonly include rigid metallic friction wedges or shoes that are carried in bolster pockets and are maintained in frictional engagement with respective side frame column wear surfaces. The friction shoes dissipate suspension system energy by frictionally damping relative motion, especially vertical motion, between the bolster and the side frames. Such rigid friction shoes have been used in practically all freight car trucks built in the past 40 years.

More recently, elastomeric friction elements have been developed for use in place of rigid friction shoes. For example, I have previously developed elastomeric friction elements as shown and described in U.S. Pat. No. 4,230,047, now U.S. Reissue Pat. No. 31,784, and U.S. Pat. No. 4,295,429, now U.S. Reissue Pat. No. 31,988. The elastomeric friction elements disclosed in these patents offer improved damping for all modes of relative bolster to side frame motion. I have also developed railway truck bolster friction assemblies that include combined rigid and elastomeric elements where the rigid element is maintained in frictional engagement with a side frame column wear surface and a resilient, deformable elastomeric element is disposed between the rigid friction element and a sloping inner surface of the bolster pocket.

Also known in the art are so-called winged friction shoes which include laterally projecting wing portions with sloping engagement surfaces disposed for frictional engagement with complementary sloping inner surface portions of a bolster pocket. Such winged friction shoe arrangements have been contemplated heretofore only for constant or fixed bias frictional damping structures in which the retention spring that maintains the friction shoe in biased engagement with the bolster pocket surface and the side frame column wear surface is supported with respect to the friction shoe by a spring base or seat portion of the bolster that extends beneath the friction shoe. Such arrangements are characterized as offering fixed or constant bias because the compression of the friction assembly retention spring remains essentially unchanged during relative movement, especially vertical movement, of the bolster with respect to the side frame. Accordingly, in a constant bias arrangement the biasing force of the retention spring upon the friction shoe, and thus the frictional force sustained between the friction shoe and the respective confining surfaces of the column wear plate and the bolster pocket inner surface, remains essentially constant throughout relative motion between the bolster and the side frames of the truck and for all freight car lading conditions from empty to fully loaded.

Fixed bias frictional damping arrangements, as above characterized, are distinguished from variable bias arrangements wherein the friction assembly retention spring extends between the friction shoe and the side frame spring seat, and the frictional response of the friction shoe thus varies with variation in the compression of the friction assembly retention spring. Accordingly, in variable bias arrangements the compression of the friction shoe retention springs, and therefore the magnitude of friction between the friction shoe and the side frame column, varies as the bolster moves vertically with respect to the side frame such as occurs under normal operating conditions or when an empty car is being loaded with freight. Thus, with a variable bias friction assembly, the frictional damping response of the friction assembly is different for loaded and empty cars whereas with a fixed bias friction assembly the damping response remains essentially uniform for all lading conditions.

For fixed friction arrangements as above characterized, the friction shoe typically includes an elongated spring pocket extending therewithin and usually disposed laterally between a pair of wing portions which include laterally spaced bolster contacting surfaces as above described. The spring pocket accommodates an optimized retention spring of sufficient length and coil diameter to provide adequate frictional damping, especially for empty or lightly loaded conditions. In known variable friction arrangements, the available vertical distance between the friction shoe and the side frame spring seat generally has been considered to be more than sufficient, even under fully loaded conditions, to accommodate a spring with a suitable design characteristic in accordance with higher capacity loaded car standards.

Among the issued patents known to me which pertain to railway truck bolster friction apparatus of the type to which my present invention relates, the following may be material to my invention as characterizing the state of the art: U.S. Pat. Nos. 3,977,332, 4,109,585, 4,274,340, 3,802,353, 4,570,544, 4,256,041, 4,254,713, 2,456,635, 2,465,763, 2,512,829, 2,574,348, 3,712,247, 2,603,166, 3,109,387, 2,548,223 and 3,072,076.

BRIEF SUMMARY OF THE INVENTION

Practitioners of the art continue to seek solutions to a variety of interrelated problems pertaining to control of relative movement in railway trucks between the bolster and the side frames. For example, difficulties have been encountered in the effort to develop friction assemblies which provide both adequate stability for a light or empty car, and sufficient frictional damping to control the dynamics of relative bolster to side frame movement for heavy or loaded cars. These problems have resulted in part from the limitations of railway industry design requirements for springs, and partially from other design limitations including truck geometry and dimensional limitations, and truck assembly considerations.

My invention pertains to a novel railway truck and truck bolster friction assembly which, among other benefits, affords an increased latitude of design parameters within which to address the problems associated with rail car instability due to inadequate control of relative bolster-to-side frame motion. More specifically, my invention contemplates a novel variable bias friction assembly with a retention spring that is supported, for example, on the side frame spring seat so that the friction assembly bias varies with the relative position of the bolster with respect to the side frame. Also according to my invention, the combination of a winged friction shoe (i.e., one having laterally spaced bolster contacting surfaces) with a longer biasing or retention spring means that extends in a cavity or spring pocket provides both enhanced lateral stability for light or empty cars and sufficient frictional damping performance for loaded cars.

As has been noted, improved empty car lateral stability has been achieved in the prior art with constant friction arrangements employing a friction shoe with laterally spaced bolster contacting surfaces and a fixed bias retention spring; however, such constant friction assemblies with constant bias springs cannot furnish sufficient damping to control rocking of heavier, loaded cars due to the fixed bias characteristic of the design which must be limited so as not to furnish excessive damping for lighter empty car bodies. Similarly, in known variable bias friction assemblies, the limitations on retention spring length (i.e., the maximum distance from the side frame spring seat to the retention spring interface with the friction shoe disposed in the bolster pocket) limits the available bias that can be realized within the industry design limitations for empty car lateral stability and maximum spring stress limitations when the spring is compressed to solid.

The longer biasing springs that can be accommodated by the friction shoe according to the instant invention can be designed to provide a higher biasing force at the empty car spring height than is possible with a conventional variable bias friction assembly. That is, by accommodating a longer retention spring, the instant invention permits the use of a spring with more coils (i.e. greater wire length), greater solid spring height and higher biasing load at the empty car spring height than a shorter (i.e. fewer coils and shorter wire length) retention spring.

All other design parameters, including coil pitch, being equal, a longer spring (total wire length) is a softer spring. That is, it will have a lower spring constant as the wire torque which results upon a given absolute spring deflection is distributed over greater wire length. Thus, such a longer spring will tolerate greater maximum deflection before reaching the fatigue limit, a design limitation which must be strictly observed. As the longer spring provides greater absolute deflection from no load to the fatigue limit, the longer, lower spring constant spring provides the advantage of higher friction assembly bias at the unloaded or empty car spring height due to the possibility of an earlier (i.e. higher level) initial friction assembly retention spring contact or loading point.

By the same token, since the spring constant of the longer spring is lower, the spring can be designed to provide maximum bias at the loaded car spring height which is identical to the desirable biasing achieved by conventional shorter springs at loaded car conditions in conventional variable bias friction assemblies.

The above explanation may be more readily understood upon reference to FIG. 5 which illustrates schematically the maximum deflection of a shorter and a longer spring from no load to maximum load conditions with spring deflection indicated on the horizontal axis and spring bias indicated on the vertical axis. The common point P of maximum spring bias is where the plots of the spring constant for the shorter spring S and the longer spring L intersect.

As shown, the longer spring has a greater maximum deflection available than does the shorter spring. In addition, the distance between the no load condition S' for spring S and deflection which is available with the longer spring, and the manner in which the longer spring, by utilizing a higher elevation initial contact point, will provide greater absolute bias for all deflections throughout the range from no load to maximum bias at point P.

As noted above, my invention preferably provides a winged shoe friction assembly that engages bolster slope contacting surface portions that are spaced laterally apart to thereby provide the truck squaring or warp stiffness of prior art constant friction assemblies. At the same time, my longer retention spring also furnishes sufficient column friction biasing force to control rocking of a higher capacity loaded car. In prior variable bias arrangements, such a stiffening variable friction biasing force at the loaded car spring level inherently limited the biasing force which could be achieved at the empty car spring level and produced inadequate friction levels to control lateral stability for the light or empty car at higher speeds of travel. Thus, the absence of a winged shoe in such prior art variable friction designs has also impaired their ability to reduce truck warp. This, along with the limited spring bias and resultant reduced damping, has resulted in inadequate high speed control for light cars.

According to the instant invention, the length of the friction assembly biasing spring is limited only by the length that can be assembled in the friction shoe casting spring pockets when the bolster is raised to the limits of the side frame opening or transom. The friction shoe spring pocket depth preferably also is limited to a depth that allows the biasing springs to be inserted into the cavity during assembly without mechanical interference.

As above characterized, a preferred embodiment of my invention includes a rigid winged friction shoe having a downwardly open spring pocket that extends therewithin to receive an elongated retention spring. The spring is supported with respect to the truck side frame rather than the truck bolster, for example by being seated on the side frame spring seat. To accommodate the spring pocket that projects upwardly within the rigid shoe, an integrally formed spring boss formed within the lateral extent of the shoe projects upwardly and inwardly of the shoe structure within the bolster pocket and is received into a slot or clearance formed in a sloping inner surface portion of the bolster pocket in which the friction assembly is received. Preferably, the friction assembly includes resilient elastomeric means confined between the sloping inner surface portion of the bolster pocket and complementary sloping surface portions of the friction shoe.

The spring pocket in my rigid shoe accommodates a longer retention spring, with attendant benefits as above described, than do prior variable bias friction assemblies. Accommodation of an extended retention spring provides for improved frictional damping response over that available with conventional shorter retention springs. My invention thus affords improved control over relative motion between a railway truck bolster and side frame under both light car and heavy car operating conditions.

It is therefore one object of the instant invention to provide a novel and improved railway truck bolster friction assembly.

A more specific object of the invention is to provide a friction assembly including a rigid shoe having a retention spring pocket extending therein with the spring pocket being of an axial length sufficient to accommodate a retention spring having a longer overall length, and which therefore is operatively more suitable for a variable bias friction assembly by virtue of the additional increment of spring length accommodated therein.

A different object of the invention is to provide a railway truck bolster and bolster friction assembly including a rigid shoe having a spring boss that projects outwardly of sloping, laterally spaced shoe surface portions which confront complementary sloping inner surface portions of a bolster pocket, and a spring pocket extending within the shoe into the spring boss to receive an elongated retention spring that is supported with respect to the truck side frame, the truck bolster including clearance adjacent the sloping pocket surface thereof to receive the spring boss of the rigid shoe in any operative position of the friction assembly with respect to the bolster.

It is a further object of the invention to provide a novel and improved railway truck including a friction assembly as above characterized.

These and other objects and further advantages of the invention will be better understood upon consideration of the following detailed description and the accompanying drawings in which.

Figure 1:
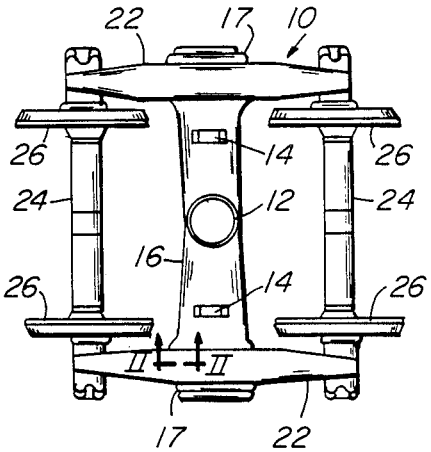
FIG. 1 is a top plan view of a railway truck constructed according to one presently preferred embodiment of my invention.
Figure 5:
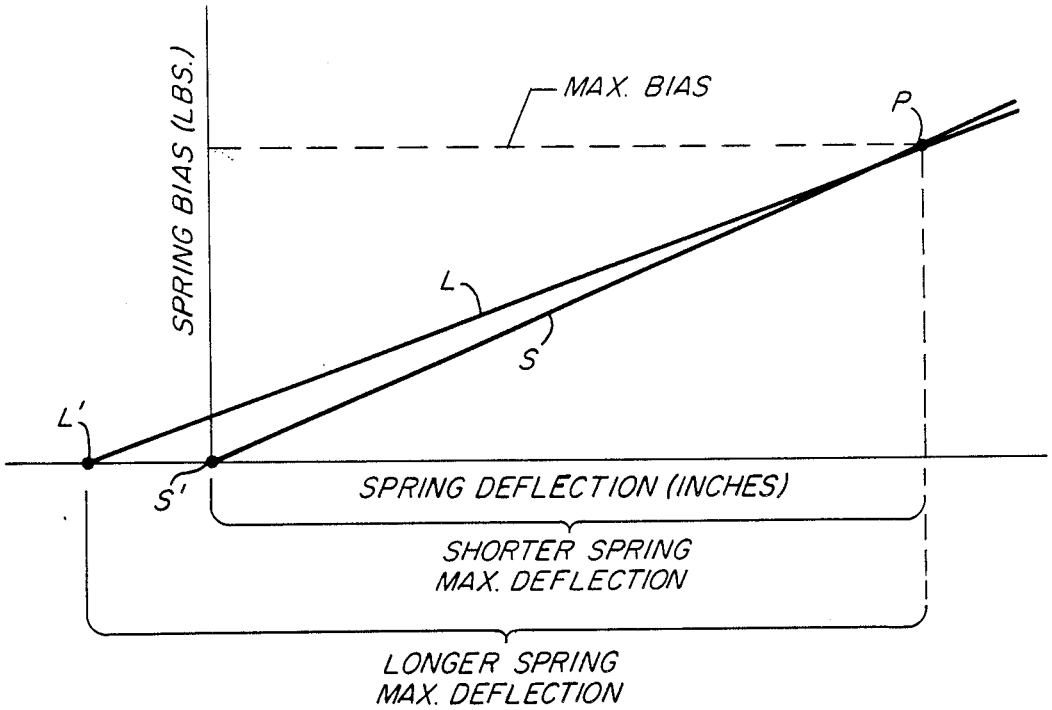
FIG. 5 is a comparative diagram of spring constants plotted on axes representing spring deflection and force.

There is generally indicated at 10 in FIG. 1 a three piece railway truck comprised of an elongated bolster 16 which has the longitudinal ends 17 thereof supported within the transom openings 19 (FIG. 4) of a pair of laterally spaced side frames 22 by well known spring groups (not shown). A pair of longitudinally spaced wheel sets 24 support the opposed ends of side frames 22 and include wheels 26 which are adapted to engage conventional rails (not shown) in rolling engagement. A centerplate 12 and side bearings 14 are provided on upper surface portions of bolster 16 intermediate side frames 22 to support a railway car body in the well known manner.

Figure 2:
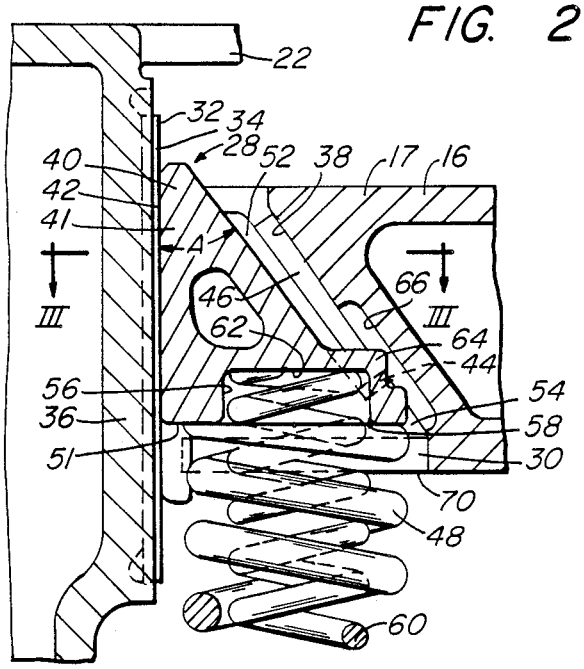
FIG. 2 is a fragmentary, sectioned elevational view of the truck of FIG. 1 taken on line II—II of FIG. 1.
Figure 3:
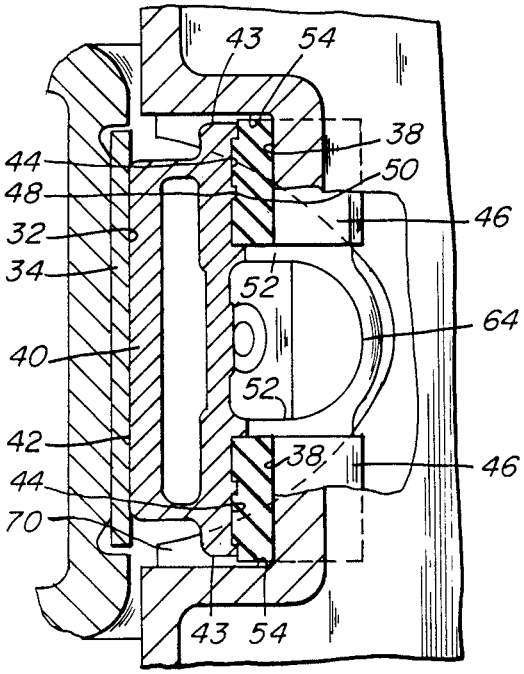
FIG. 3 is a sectioned plan view taken on line III—III of FIG. 2.

To provide fit-up of the bolster end portions 17 within the respective side frame transom openings 19 while permitting relative motion between the bolster and the side frames, and further to damp relative motion therebetween by the frictional dissipation of energy, friction assemblies 28 (FIG. 2) are received within opposed downwardly and longitudinally outwardly opening pockets 30 formed in bolster ends 17 and disposed in confronting relation with a respective side frame column portion 36. Only one friction assembly 28 and the respective pocket 30 and column portion 36 are shown in FIGS. 2 and 3. Each friction assembly 28 is maintained in engagement with a wear surface 32 of a column wear plate 34 that is carried by the side frame column portion 36, and with an inner sloping surface 38 of the respective pocket 30. Accordingly, friction assembly 28 includes a generally wedge shaped rigid shoe 40 having a surface 42 that is maintained in biased, frictionally slideable engagement with wear plate surface 32, and an opposed sloping surface 44 which is disposed in spaced confronting relationship with bolster pocket surface 38. A resilient, deformable elastomeric element 46 is disposed intermediate surfaces 44 and 38 for engagement with both, and in frictionally slideable engagement with at least one of them, preferably surface 38.

A retention spring means 48, a dual concentric coil spring assembly for example, is supported with respect to side frame 22, for example by being supported upon a spring seat portion 50 thereof. Spring means 48 extends upwardly from spring seat 50 to engage rigid shoe 40 and bias the same upwardly. Accordingly, the weight of bolster 16 and the rail car body and lading act through elastomeric element 46 and rigid shoe 40 to compress spring means 48 against spring seat 50, and the spring means 48 thus biases friction shoe 40 into frictional engagement with column wear surface 32, and the elastomeric element 46 into engagement with pocket surface 38.

Elastomeric element 46 is frictionally slideable with respect to at least one of surfaces 38 and 44, preferably surface 38 as above noted. Accordingly, elastomeric element 46 may be mechanically interlocked with the other of surfaces 38 and 44 as by means of complementary interlocking projections 48 (shown projecting from surface 44) and depressions, 50 (FIG. 3).

Friction shoe 40 preferably is a winged shoe structure having laterally projecting wing portions 43. Thus as shown in FIG. 3, surface 38 of bolster pocket 30 is comprised of a pair of laterally spaced surface portions which are engaged by a respective pair of laterally spaced elastomeric elements 46, each of which is in turn engaged upon one of a respective pair of laterally spaced portions of surface 44. In this winged shoe structure elastomeric elements 46 are preferably to be laterally confined between lateral abutments such as abutments 52 formed on rigid shoe 40 to project upwardly and outwardly of surface 44, and the laterally opposed inner side wall surfaces 54 of pocket 30.

All of the structure thus far described with reference to FIGS. 1 through 3 is known and forms no part of the present invention except insofar as such structure, in combination with novel elements yet to be described herein, may constitute patentable subject matter within the scope of the appended claims. It is believed further detailed description of such known structure as above characterized is unnecessary for an understanding of the present invention. For further detailed description of such structures, reference is made hereby to my U.S. patent application Ser. No. 291,428 filed Dec. 23, 1988. I hereby incorporate herein and make a part hereof by reference the entire disclosure of said U.S. application; Ser. No. 291,428, now U.S. Pat. No. 4,915,031.

In a non-operational state such as during truck assembly when there is no vertically upward bias on the friction shoe 40, the friction shoe is gravitationally supported upon a shelf 70 which is an integral part of bolster 16 extending at least partially beneath each bolster pocket 30. Each shelf 70 is formed with a concavity which opens outwardly toward the respective side frame to receive the vertically extending retention spring means 48, and to accommodate outward migration of the spring means 48 and the friction shoe which results from progressive wear throughout the service life of the friction assembly. In operation, the friction shoe 40 is continuously biased into engagement with the column wear surface 32 and the sloping bolster pocket surface 38 by spring means 48. It is not supported by shelf 70 either directly or indirectly during operation at any lading condition including the extremes of light or empty car operation and loaded or heavy car operation.

Rigid shoe 40 more particularly comprises a rigid body 41 of cast iron, for example, and having a generally wedge-like geometry which defines an included angle A between surfaces 42 and 44. A downwardly open spring pocket 56 extends upwardly within body 41 and includes a lower open end 58 disposed adjacent a downwardly facing surface 51 of body 41. Spring means 48 includes on elongated coil spring 60 which is received within spring pocket 56 in biased engagement with a seating surface 62 which forms the innermost end of spring pocket 56. Accordingly, spring 60 is incrementally longer than the retention spring which rigid shoe 40 could accommodate without the spring pocket 56.

To accommodate spring pocket 56 within shoe 40, a spring boss portion 64 of body 41 projects upwardly and outwardly of surface 44 intermediate the abutments 52. Spring boss 64 may also extend upwardly and outwardly beyond the innermost extent of elastomeric elements 46 into pocket 30 such that clearance within bolster pocket 30 is required to accommodate spring boss 64 therein. Accordingly, a complementary relief 66 is provided on the inner sloping wall 38 of bolster pocket 30. Relief 66 is preferably formed as an elongated recess or slot of a width laterally of pocket 30 and a depth at least great enough to accommodate spring boss 64, and of a length along the slope of surface 38 to permit movement of shoe 40 upwardly and downwardly thereon in response to both deformation of elastomeric element 46 in operation and progressive wear during the service life of the friction assembly. The relief 66 is thus formed to accommodate spring boss 64 in any and all operative positions of friction assembly 28.

As has been noted hereinabove, spring 60 is longer than the spring element which could be otherwise accommodated in the absence of spring pocket 56. The resultant increased spring length permits greater design latitude within applicable industry standards and attainment of more desirable modes of frictional response than would be otherwise attainable, specifically in that the spring pocket permits use of a spring with a more suitable stiffness characteristic for both empty car and loaded car conditions.

More specifically, the operation of the above described friction assembly is similar in many salient respects to the mode of operation of conventional variable bias railway truck bolster friction assemblies. The retention spring biases the friction shoe upwardly within the bolster pocket into biased engagement with the column wear plate friction surface and with the inner sloping surface of the bolster pocket, or in this case, with the elastomeric element which is confined between the friction shoe and the sloping inner bolster pocket surface as noted above. For the present invention, however, the retention spring is longer than the retention spring which could be utilized if the friction shoe were provided with no upwardly extending spring pocket. Accordingly, the longer friction shoe retention spring made possible by the present invention affords the opportunity to design, within the acceptable maximum stress limits imposed by the industry standards, a spring which provides a greater spring force or bias at empty car operating conditions.

This expansion of the available design options affords the opportunity for increased friction shoe retention bias and greater frictional damping capability for the empty car as well as improved control of empty car lateral stability. Sufficient frictional damping is also achieved for loaded car conditions to provide control of heavy car rocking and other modes of motion which proceed in whole or in part from reinforcement of relative bolster-to-side frame movements under loaded car conditions.

In the prior art, the length of the variable bias spring which could be utilized in a truck assembly was limited by practical considerations including the assembly clearances. The present invention permits, in a three piece truck that is assembled generally in the conventional way, a longer friction shoe retention or biasing spring than could otherwise be utilized—a spring of a length which could not be assembled into a conventional three piece truck having friction shoes without spring pockets unless the spring were first precompressed and suitably pinned or otherwise maintained in a precompressed state prior to and during assembly. In this respect, constant bias arrangements have suffered from the same shortcoming in that assembly thereof has typically required precompression of the retention springs in the friction shoe spring pocket where the spring is then pinned in its precompressed state in the bolster pocket prior to assembly of the bolster ends into the side frame transoms.

The benefits of increased spring length, as above described, are attained by one presently preferred embodiment of the instant invention without resorting to an elongated spring pocket as in conventional fixed bias friction shoes with spring pockets. In such arrangements, the clearance required by the spring boss effectively requires the sloping friction surface of the shoe to be divided laterally throughout substantially its entire vertical extent. The referenced presently preferred embodiment of the invention accommodates an incrementally longer retention spring while requiring only a relatively small recess for added clearance in the innermost wall of the bolster.

For the present invention, a resilient elastomeric means disposed within the bolster pocket between the respective confronting sloping surfaces of the bolster pocket and the friction shoe may include laterally projecting wing portions which extend vertically along the sloping interface from lower to upper regions thereof on either lateral side of the spring boss, and a laterally extending portion which extends laterally between the wing portions above the spring boss to engage the corresponding portion of the sloping bolster pocket surface above the required spring boss clearance. Such a resilient elastomeric means can be a unitary member or multiple elastomeric elements consisting of the portions described directly above, or other combinations of plural elastomeric elements consistent with the configuration of the available confronting surfaces of the bolster pocket and the friction shoe.

Figure 4:
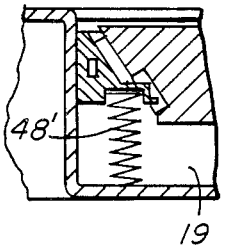
FIG. 4 is a fragmentary, sectioned side elevation of a truck showing an alternative embodiment of the invention.
Figure 4:
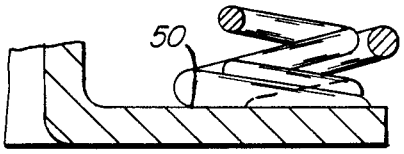

According to the description hereinabove, I have invented a novel and improved railway truck, truck bolster, and friction assembly. Of course, I have envisioned a variety of alternative and modified embodiments apart from the presently preferred best mode embodiments disclosed hereinabove. For example, in lieu of the dual concentric coil retention spring assembly as shown in FIG. 2, a single spring alternative is contemplated wherein the single spring extends upwardly into the friction shoe spring pocket as shown in FIG. 4 at 48'. Additionally, with a dual concentric coil spring arrangement as shown in FIG. 2, both springs may be received into the friction shoe spring pocket rather than only one of them. This and other alternative and modified embodiments surely would also occur to others versed in the art once apprised of my invention. Accordingly, it is my intent that the invention be construed broadly and limited only by scope properly attibutable to the claims appended hereto.

I claim:

1. A railway truck assembly comprising:

a pair of elongated, laterally spaced side frames of a conventional structure;

each said side frame having a longitudinally extending transom opening therein with horizontally opposed ends and vertically extending side frame surfaces adjacent said horizontally opposed ends of said transom opening, and an upwardly facing spring seat surface extending longitudinally of a lower portion of said transom opening intermediate said side frame surfaces;

an elongated bolster extending between said side frames with opposed longitudinal end portions thereof being received within said transom openings, respectively;

said bolster having outwardly and downwardly open pockets extending inwardly from opposed external sides of each of said end portions;

each said pocket having an inner sloping surface which extends vertically in spaced, angled relation with respect to a respective one of said side frame surfaces;

shoe assemblies located in engagement with said side frame surfaces and with at least a given vertical extent of the respective said inner sloping surfaces for relative sliding movement thereon, respectively;

said bolster having elongated open recesses which extend inwardly of said inner sloping surfaces, respectively, and vertically thereof, with at least a portion of each said recess extending within said given vertical extent;

said shoe assemblies including rigid shoes with integral means which extend into said recesses, respectively;

said integral means being moveable within the confines of said recesses, respectively, including movement thereof within said portions of said recesses, to accommodate the normal range of relative sliding movement of said shoe assemblies on said inner sloping surfaces respectively;

each said rigid shoe having a spring receiving opening which extends upwardly therein and having an innermost end surface of said opening which is vertically spaced from said spring seat surface;

elongated coil spring means extending between said innermost end surfaces and said spring seat surface, respectively;

each of said coil spring means having adjacent coils thereof spaced apart to permit compression of said coil spring means to accommodate said relative sliding movement; and load spring means extending between said end portions of said bolster and said spring seat surfaces, respectively, to support said bolster with respect to said side frames.

2. The railway truck as set forth in claim 1 wherein each said rigid shoe includes opposed, laterally outwardly projecting wing portions which confront said inner sloping surface of the respective said pocket.

3. The railway truck as set forth in claim 2 wherein said integral means of each said rigid shoe is located laterally intermediate said wing portions.

4. The railway truck as set forth in claim 3 wherein each said shoe assembly additionally includes elastomeric means located in engagement with said wing portions, respectively, and with the respective said inner sloping surface.

5. The railway truck as set forth in claim 1 wherein each said coil spring means is a multiple spring assembly.

6. The railway truck as set forth in claim 1 wherein each said coil spring means is a single unitary spring.

7. In a railway truck assembly wherein each of a pair of elongated, laterally spaced side frames includes a longitudinally extending transom opening therein with horizontally opposed ends and vertically extending side frame surfaces adjacent the horizontally opposed ends of the transom opening and an upwardly facing spring seat surface extending longitudinally of a lower portion of the transom opening, a bolster and friction damper assembly for operative engagement with such side frames comprising:

an elongated bolster extending between such side frames;

said bolster having opposed longitudinal end portions which are received within such transom openings, respectively;

said bolster having outwardly and downwardly open pockets extending inwardly from opposed external sides of each of said end portions;

each said pocket having an inner sloping surface which extends vertically in spaced, angled relation with respect to a respective one of such side frame surfaces;

shoe assemblies disposed within said pockets, respectively, in engagement with at least a given vertical extent of the respective said inner sloping surfaces and adapted to engage respective ones of such side frame surfaces for relative sliding movement on said inner sloping surfaces and such side frame surfaces, respectively;

said bolster having elongated open recesses which extend inwardly of said inner sloping surfaces respectively, and vertically thereof with at least a portion of each said recess extending within said given vertical extent;

said shoe assemblies including rigid shoes with integral means which extend into said recesses, respectively;

said integral means being moveable within the confines of said recesses, respectively, including movement thereof within said portions of said recesses, to accommodate the normal range of relative sliding movement of said shoe assemblies on said inner sloping surfaces, respectively;

each said rigid shoe having a spring receiving opening which extends upwardly therein and having an innermost end surface of said opening which is adapted to be vertically spaced from such a spring seat surface;

elongated coil spring means engaging said innermost end surfaces and adapted to engage such a spring seat surface; and each of said coil spring means having adjacent coils thereof spaced apart to permit compression of said coil spring means to accommodate said relative sliding movement.

8. In a railway truck which includes a pair of conventional side frames and a bolster having the opposed longitudinal ends thereof received within respective transom openings of such side frames such that longitudinally opposed, outwardly and downwardly open bolster pockets are disposed in confronting relation with respect to longitudinally spaced column guides of such side frames, respectively, and wherein each bolster pocket includes an inner sloping surface and each column guide includes a wear surface disposed in spaced confronting relationship with respect to such an inner sloping surface, a friction assembly adapted to be assembled with such a truck in operative engagement with such a sloping surface and such a wear surface comprising:

a rigid shoe having a first surface means which is adapted for operative interaction with such a wear surface, a second surface means which extends throughout a given vertical extent at a given included angle with respect to said first surface and is adapted for operative interaction with such an inner sloping surface throughout said given vertical extent, and a lower surface portion which extends intermediate said first and second surfaces within said included angle;

said rigid shoe including a boss means which projects outwardly of said second surface at least partially within said given vertical extent and is adapted to project inwardly into such a pocket beyond the outermost extent of the respective inner sloping surface;

said rigid shoe further including a downwardly open recess extending upwardly therein from said lower surface portion and having an innermost end surface which is located within said given vertical extent; and an elongated biasing spring means having one longitudinal end thereof received within said downwardly open recess in engagement with said innermost end surface and the opposed longitudinal end thereof adapted to be supported by a spring support portion of such a side frame.

9. The friction assembly as set forth in claim 8 wherein said biasing spring means in its uncompressed state has a longitudinal extent greater than the maximum distance between such a spring support portion and said lower surface portion of said rigid shoe when said shoe is disposed within such a bolster pocket with said first and second surfaces engaged for operative interaction with such wear and sloping surfaces, respectively.

10. The friction assembly as set forth in claim 9 additionally including elastomeric elements which are engageable with said second surface and are adapted to engage such a bolster pocket sloping inner surface to provide said operative interaction therebetween.

* * * * *